US007017683B2

(12) United States Patent
Narvestad

(10) Patent No.: US 7,017,683 B2
(45) Date of Patent: Mar. 28, 2006

(54) CUTTER FOR TUNNEL BORING MACHINE

(76) Inventor: Stein Narvestad, President Harbitz gate 23 A, N-0259 Oslo (NO)

( * ) Notice: Subject to any disclaimer, the term of this patent is extended or adjusted under 35 U.S.C. 154(b) by 0 days.

(21) Appl. No.: 10/373,850

(22) Filed: Feb. 27, 2003

(65) Prior Publication Data

US 2004/0168833 A1 Sep. 2, 2004

(51) Int. Cl.
*E21B 10/12* (2006.01)

(52) U.S. Cl. ..... 175/373; 175/351; 175/368; 299/79.1

(58) Field of Classification Search ..... 175/373, 175/351, 352, 413, 368; 411/414, 265; 299/79.1
See application file for complete search history.

(56) References Cited

U.S. PATENT DOCUMENTS 3,586,351 A * 6/1971 Vanderveen et al. ..... 285/89
3,662,468 A * 5/1972 Kolb et al. ..... 33/27.02
3,707,315 A * 12/1972 Goodfellow ..... 384/92
3,982,595 A * 9/1976 Ott ..... 175/373
4,004,645 A * 1/1977 Rees et al. ..... 175/373
4,793,427 A 12/1988 Lambson
5,253,723 A * 10/1993 Narvestad ..... 175/373
5,341,889 A 8/1994 Narvestad
5,421,422 A 6/1995 Crane
5,961,185 A * 10/1999 Friant et al. ..... 299/33
6,343,842 B1 * 2/2002 Sauer et al. ..... 299/79.1

FOREIGN PATENT DOCUMENTS

NO 169859 10/1991
WO WO 88/05117 7/1988

* cited by examiner

*Primary Examiner*—David Bagnell
*Assistant Examiner*—Shane Bomar
(74) *Attorney, Agent, or Firm*—Christian D. Abel

(57) ABSTRACT

A cutter for a tunnel boring machine is equipped with a cutter body (1) with a slanting surface (2), a cylindrical contact surface (12) and a preferably tapered threaded portion with specially designed threads (6), a clamping ring (4) with threads adapted to the cutter body's threads with a slanting surface (5) with a groove (13) with a spring (14). The cutter has an undivided (3) or divided cutter ring (with segments 3*a*, 3*b*) with a cross section with slanting lateral surfaces (7, 8) in the foot and a cylindrical contact surface (11). The diameter of the cutter ring's cylindrical contact surface (11) has a clearance tolerance relative to the diameter of the cylindrical contact surface (12) of the cutter body.

5 Claims, 7 Drawing Sheets

A-A

CUTTER FOR TUNNEL BORING MACHINE

BACKGROUND

1. Field of Invention

The invention relates to a cutter for a tunnel boring machine as indicated in the introduction to claim 1.

2. Description of Prior Art

Machines for mechanical boring of tunnels are called tunnel boring machines (TBM). They have a rotating drill head, on which are mounted excavation tools for breaking off the material that has to be removed in the tunnel front. The most common excavation tools are called cutters, which break off the material that has to be removed by being pressed in against the tunnel front and forced to rotate by means of rotation of the drill head.

A cutter has a shaft, which is fixed to the drill head, and a cutter body with a steel ring—called a cutter ring—rotates about this shaft. The cutter ring, which is in direct contact with the material in the tunnel front, becomes worn and has to be replaced. As a rule the consumption of cutter rings is many times that of the cutter's other components.

Simplifying the task of replacing the cutter rings may provide substantial cost reductions.

There are cutters for TBM with undivided as well as divided cutter rings.

In principle, different techniques are employed for fixing undivided and divided cutter rings to the cutter body. Undivided cutter rings are heated and shrunk on to the cutter body, and a locking ring with a split is inserted in a groove on the side of the cutter ring, and the split is welded. The lateral surfaces in the foot of undivided cutter rings are parallel to the plane through the cutter's cutting edge. For divided cutter rings that have slanting lateral surfaces in the foot, fixing elements are used that are pressed into a wedge-shaped opening between the cutter body and the cutter ring by means of screws, thereby fixing the cutter rings, cf. U.S. Pat. Nos. 5,341,889, 4,793,427, NO patent 109859, etc. FIG. I in the attached drawings illustrates the methods of construction.

When the cutter ring on a cutter with an undivided ring has to be replaced, the whole cutter has to be dismantled and taken to the workshop in order to have a new ring mounted.

When the cutter ring on a cutter with a divided ring has to be changed, only the cutter ring segments are replaced while the cutter remains on the drill head.

Since cutters weigh 100–200 kg, while the cutter ring weighs 20–30 kg, a great deal of time and work is saved with regard to ring replacement with divided cutter rings, as well as reducing the risk involved in the operation.

There is substantial cutter consumption in the case of hard and abrasive rock. The potential savings that can be made by using divided cutter rings are greatest in such conditions.

Experience with divided cutter rings has shown a tendency for fracture to occur in the gap between the ring segments in some cutter positions, out towards the periphery of the TBM drill head. Here the cutter rings are exposed to considerable lateral loads due to the fact that the cutters are at an angle to the TBM axis. These positions normally have a very high replacement frequency in hard rock.

A fair amount of variation is usually found in the rock formations in the tunnel route. This makes it desirable to have the ability to alternate between cutters with divided and undivided rings as the working conditions change. Since the known constructions of cutters with whole and divided rings are so different, with the current technology it is not possible to alternate between whole and divided cutter rings without replacing the entire cutter system. This will entail an increased number of spare cutters and reduce the savings achieved by using divided rings. For this reason cutters with divided rings have had little impact on the market, despite the substantial savings potential.

In Norwegian patent NO 169859 (belonging to the applicant) a clamping ring is employed for securing a cutter ring consisting of several segments. The clamping ring is designed with a slanting lateral edge that is adapted to the opposite slanting lateral surface of the cutter ring (complementarily shaped), and the clamping ring is pulled into position in a suitable groove in a cutter ring, thereby holding the cutter ring in place by means of its wedge shape.

Furthermore, in U.S. Pat. No. 4,793,427 a ring is described for securing a cutter ring (13) in a tool. The ring is pulled in a threaded connection between the ring and the cutter, thereby holding the cutter in place by means of two annular shoulders without exerting radially outwardly directed forces on the cutter ring. It should also be noted that the cutter ring in U.S. Pat. No. 4,793,427 is a hard metal ring with a low interference fit (sliding fit) to the cutter body. A hard metal ring as indicated in U.S. Pat. No. 4,793,427 is used in shaft boring and not in a TBM. Rings of this kind cannot be used with the cutter pressures of 20–30 tons employed in TBM boring today, since they crack at such pressure.

OBJECTS AND ADVANTAGES

The object of the present invention is to provide a cutter for tunnel boring machines that permits simpler and faster replacement, which represents a considerable saving in the operation of a TBM, while at the same time ensuring that the cutter is secured in a reliable manner.

SUMMARY OF THE INVENTION

This object is achieved with a cutter, which is characterised by that which is set forth in the claims. With the invention, the cutter ring is secured by substantial radial and axial frictional forces.

The invention makes it possible to mount divided and whole cutter rings on the same cutter body, and to alternate between whole and half cutter rings in the individual cutter position on the drill head as the working conditions vary.

BRIEF DESCRIPTION OF THE DRAWINGS

The cutter according to the invention will now be described in greater detail by means of embodiments illustrated in the drawing, in which:

FIGS. IA and IB illustrate examples of the prior art for a whole and divided cutter ring, viewed partly in section, FIG. II illustrates a cutter with a divided ring according to the principle of the invention, according to a first embodiment, FIGS. IIIA and B illustrate a divided cutter ring in cross section and front view designed according to the principle of the invention, viewed without the details from FIG. II, FIGS. IVA and B are a view corresponding to FIG. III of a variant of the embodiment, FIGS. VA, B and C illustrate a clamping ring according to the principle of the invention, where FIG. VB is an enlarged view of the encircled area, and C an alternative design, FIGS. VIA, B and C illustrate an example of a specially designed mounting bracket for cutters for utilisation of the principle of the invention, shown in two side views and a view illustrating insertion of the cutter in the bracket, and FIGS. VIIA, B and C are views illustrating a possible shape for an undivided ring in section (FIG. VIIA), a groove in an undivided ring (FIG. B) and a bevelling in a divided ring to receive the plug (FIG. C).

DETAILED DESCRIPTION OF THE INVENTION

Figure 1B:
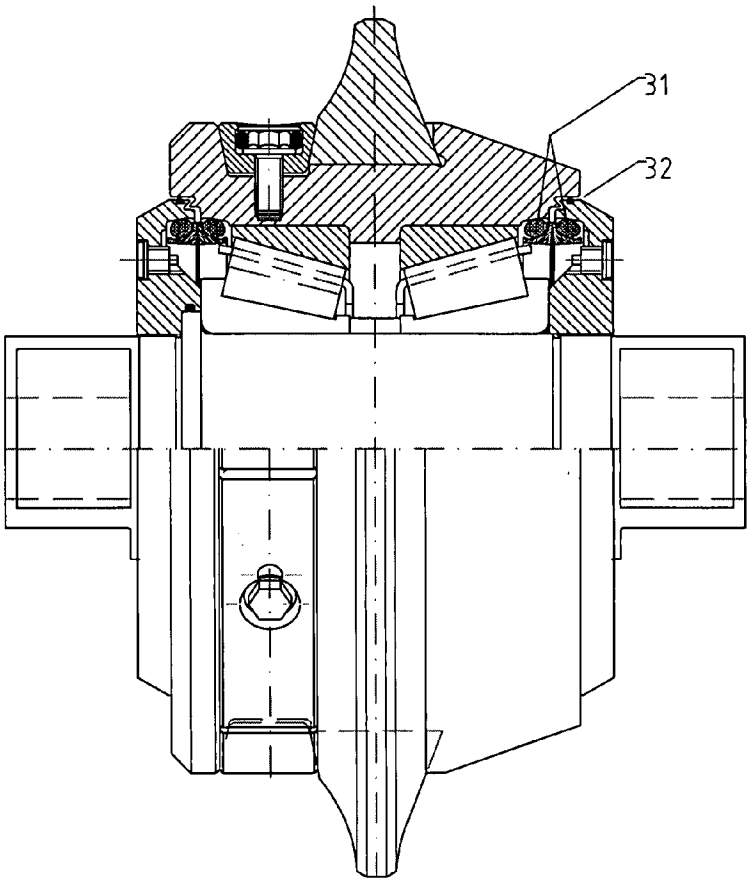
Figure 1A:
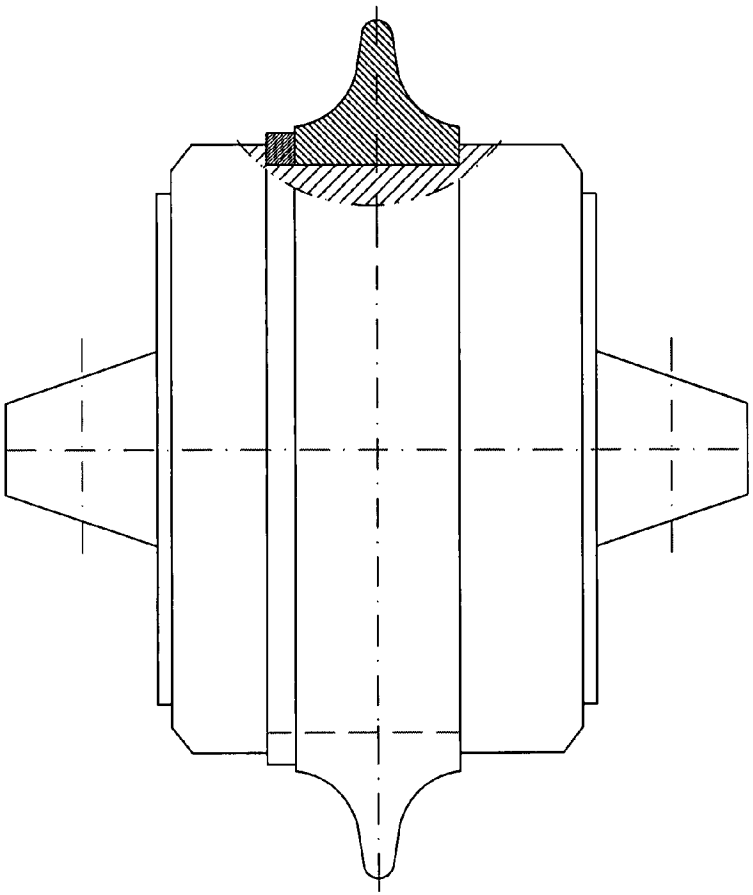
Fig 1A Prior Art
Figure 2:
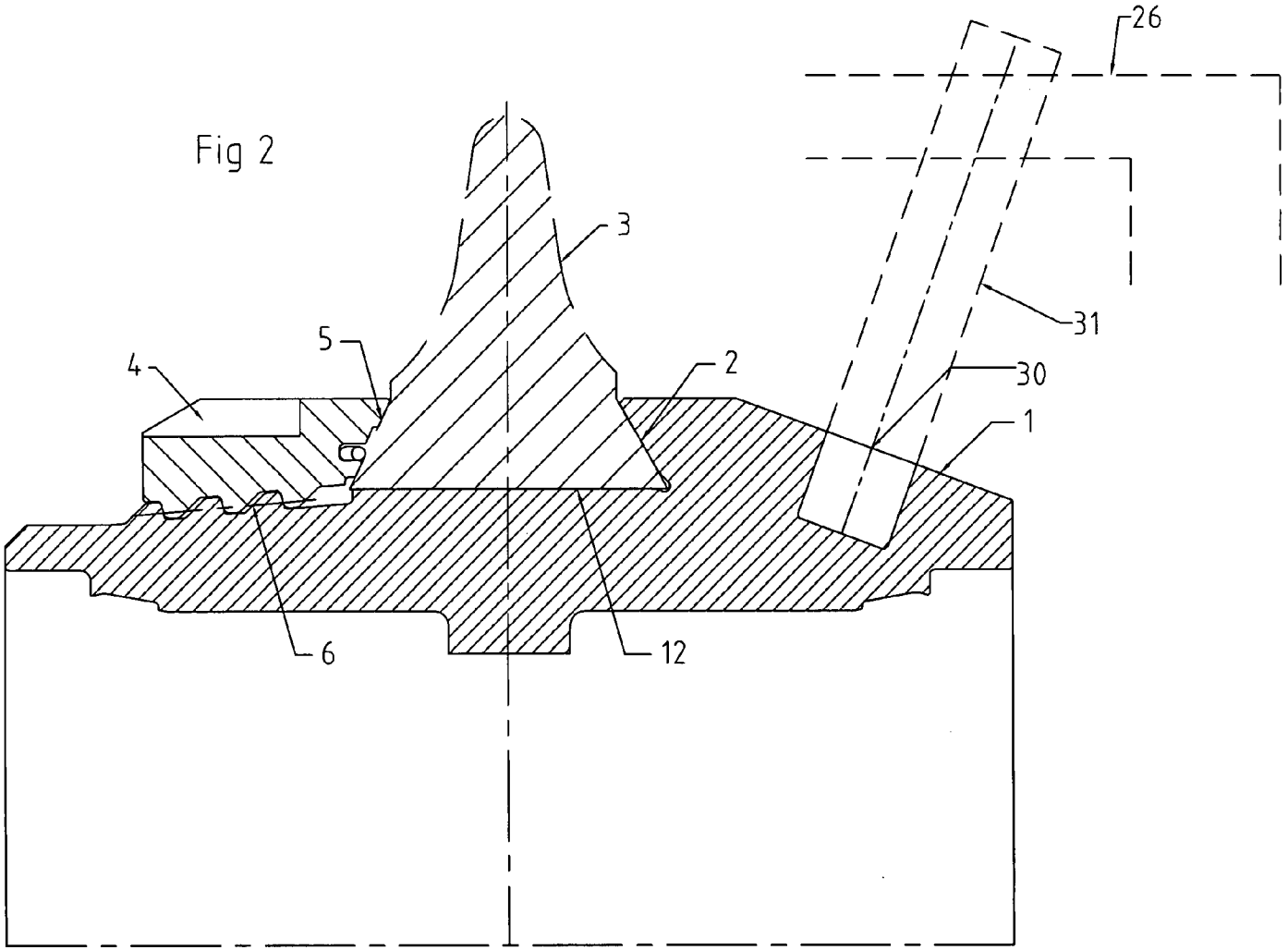
Figure 3A:
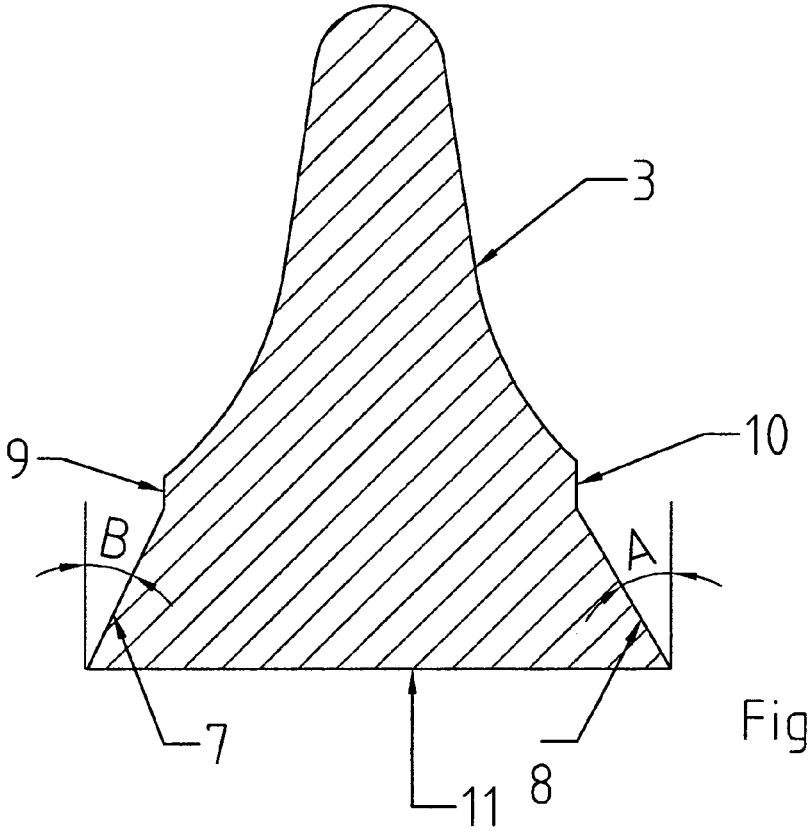
Figure 3B:
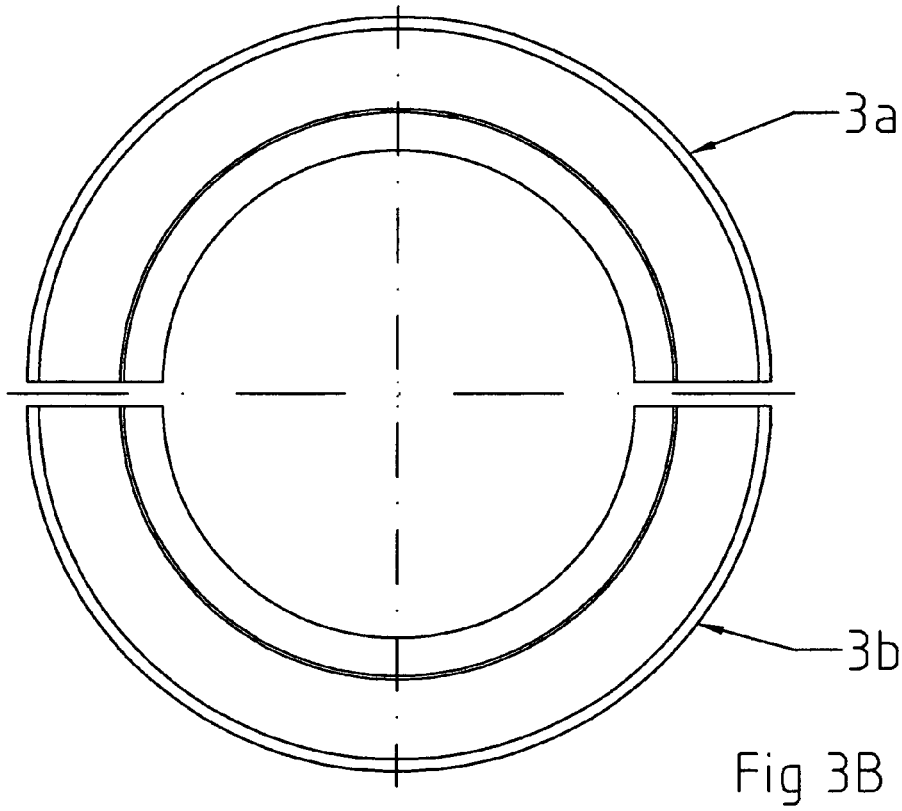
Figure 4A:
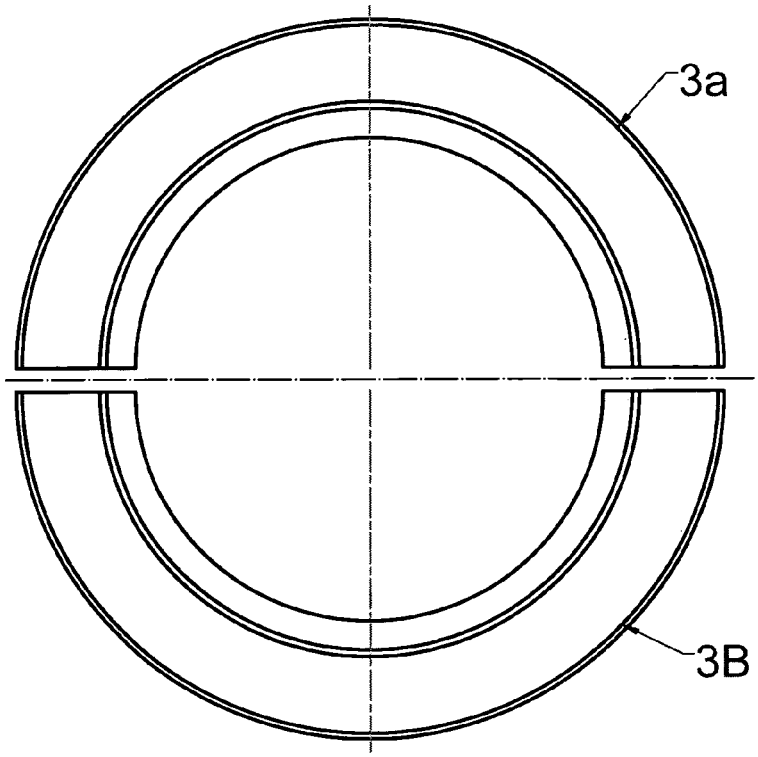
Figure 4B:
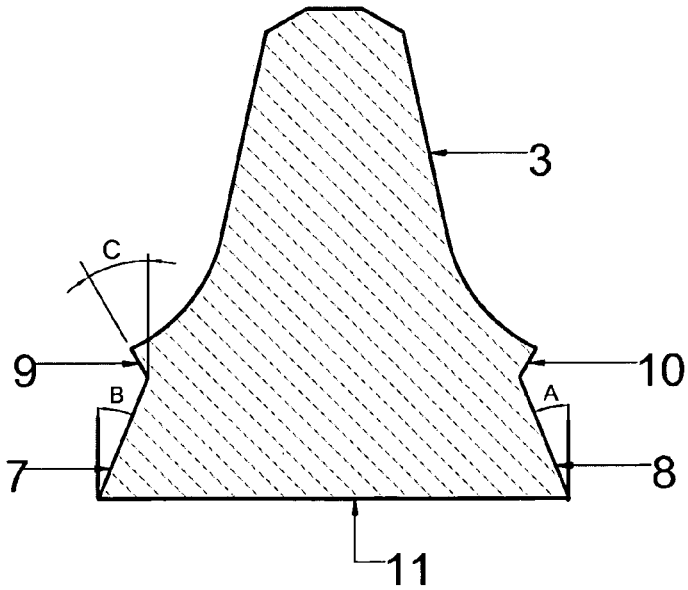
Figure 5A:
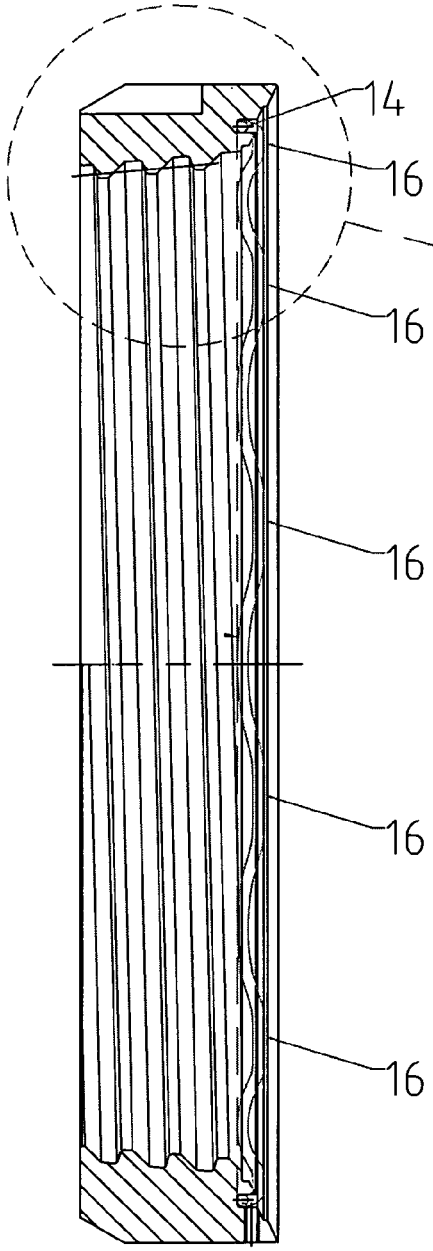
Figure 5B:
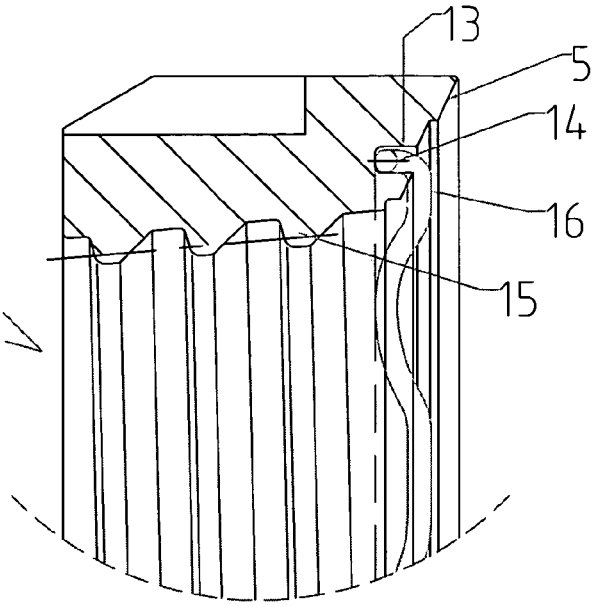
Figure 5C:
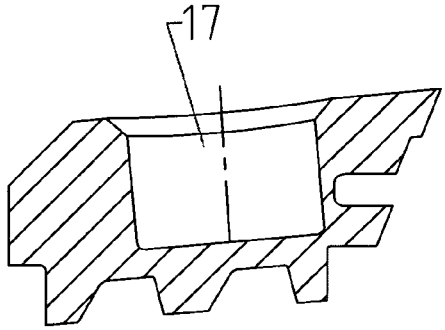
Figure 6A:
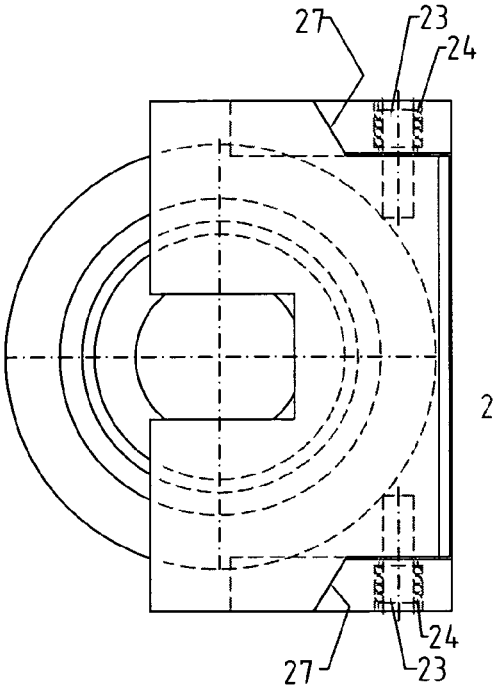
Figure 6B:
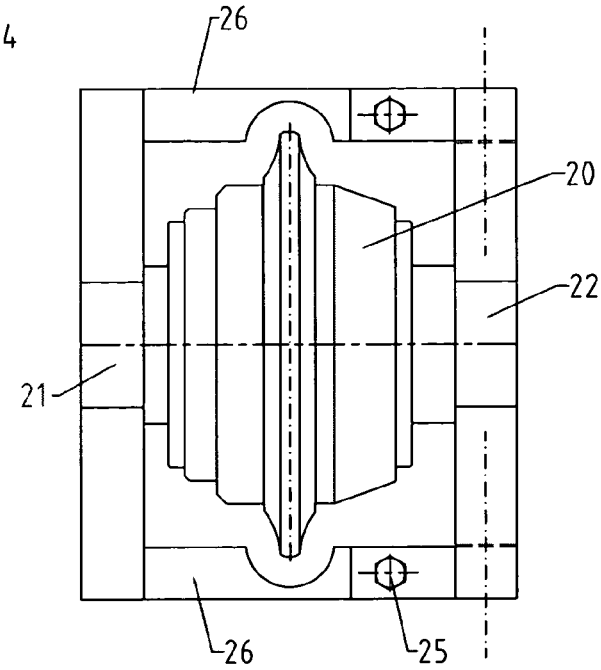
Figure 6C:
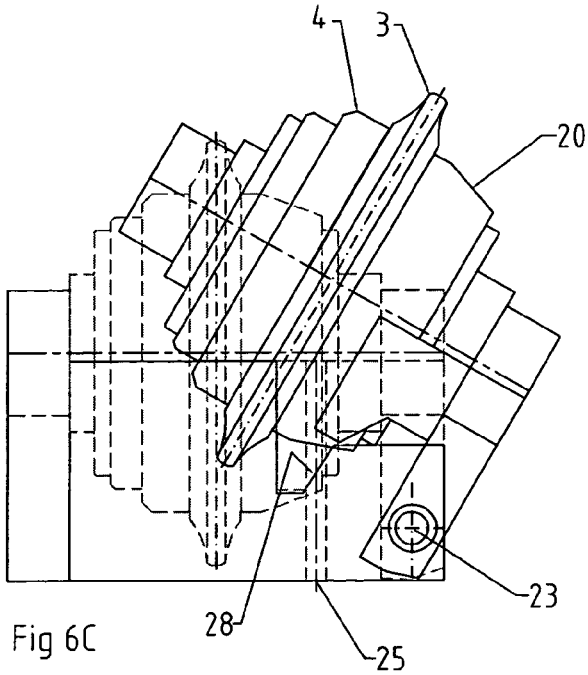
Figure 7C:
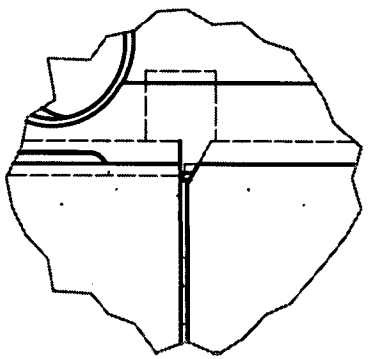
Figure 7B:
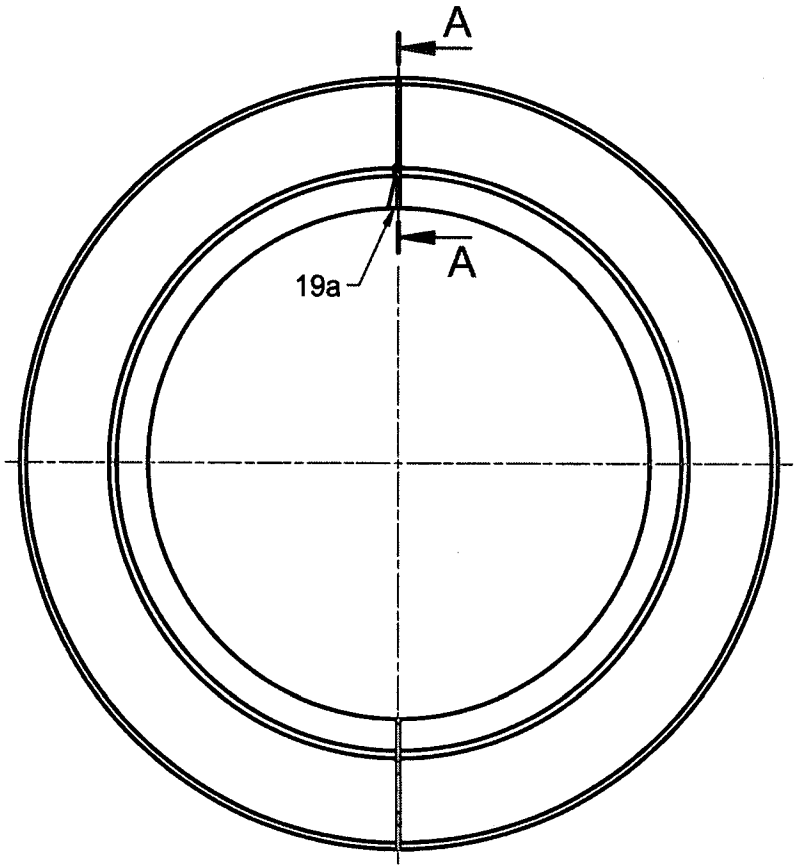
Figure 7A:
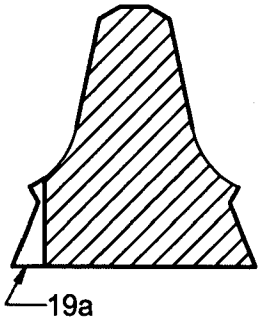

FIGS. IA and B illustrate examples of the prior art where FIG. IA shows a cutter with a whole cutter ring and FIG. IB shows a cutter with a divided cutter ring.

FIG. II illustrates a cutter designed according to the principle of the invention. The cutter body 1 has a slanting contact surface 2, against which the cutter rings 3 are pressed with tremendous force by the slanting surface 5 of the clamping ring 4, the clamping ring being moved sideways on a specially designed thread in the threaded portion 6 on the cutter body. The top of these threads has a smaller diameter than the cutter body's cylindrical contact surface 12, thus enabling an undivided ring to be inserted from the side when the clamping ring 4 is unscrewed. The cutter ring 3, which is illustrated in greater detail in FIGS. III and IV, has a dovetailed foot with adjacent angles A, B and slanting surfaces 7, 8, which change to short, flat surfaces 9, 10, which are parallel to a plane through the edge of the cutter ring. In FIG. IVB a second, preferred embodiment is illustrated where the surfaces 9, 10 are not parallel but form an angle c outwards relative to the plane through the edge of the cutter ring. The cutter ring has a cylindrical flat contact surface 11 facing the corresponding cylindrical surface 12 of the cutter body. The divided cutter rings are identical to the undivided rings, apart from the dividing section, and the diameter of the cylindrical surfaces 11 on both divided and undivided cutter rings has a clearance tolerance relative to the diameter of the cutter body's cylindrical surfaces 12. Only divided rings are shown to illustrate this. The term clearance tolerance refers to a clearance as a result of a difference in diameter between the inner surface and the outer, abutting surface in order to prevent the cutter ring from "binding" to the cutter body, thus enabling undivided rings to be replaced manually.

FIGS. VIIA and B illustrate how to secure the positioning of the cutter ring. For this purpose a positioning plug 19 with a nose projecting, e.g. over the cutter body's cylindrical contact surface 12 is placed in a hole 18 in the cutter body. The plug nose preferably has a wedge-shaped cross section. The position of the plug is not illustrated in greater detail. In the case of an undivided cutter ring, there will be a groove 19*a* for inserting the ring from the side in FIGS. VIIA and B, while FIG. VIIC shows how in the case of a divided ring a bevelling 17 of the dividing lateral surface in the internal area can serve the same purpose.

When a whole cutter ring 3 is mounted on the cutter body 1, it is secured mainly by the frictional forces between its slanting surfaces 7, 8 and the cutter body's slanting surface 2 and the clamping ring's slanting surface 5 respectively.

When a divided cutter ring 3 with segments 3*a*, 3*b* is mounted on the cutter body 1, the cutter ring segments are substantially secured by the frictional forces between the cutter ring's cylindrical surface 11 and the cutter body's cylindrical contact surface 12, the gap in the divided ring permitting the cutter ring segments to be pressed in against the cutter body by the two radial force components from clamping ring and cutter body respectively against the surfaces 7, 8 of the cutter ring.

For both a divided and an undivided cutter ring, the nose of the plug 18 is a safeguard against the cutter ring moving relative to the cutter body.

Divided cutter rings have been known to move on the cutter body because the ring segments' 3*a*, 3*b* slanting surface 8 is not pressed in against the cutter body's slanting surface 2 with sufficient force, thereby causing inadequate radial frictional force between the cylindrical surfaces 11 and 12. The cutter body 1 then becomes damaged in the course of a short time. The reason for this has been that, on account of friction between the cylindrical surfaces 11 and 12 on cutter ring and cutter body respectively, the radial component of the stress force from the securing elements on the cutter ring's lateral surface 7 has counteracted the cutter segments' lateral movement against the cutter body's slanting surface 2. In order to ensure that the cutter ring segments' slanting surface 8 is pressed against the cutter body's slanting surface 2 with sufficient force, the clamping ring in FIG. IV is provided with a groove 13 in the slanting surface 5 where a strong, corrugated spring 14 is mounted with many contact points against each of the cutting ring segments 3*a*, 3*b*. In an unloaded state the crests of the spring's waves 16 project above the clamping ring's contact surface 5 against the cutter ring. The spring 14 is designed so as to ensure full contact against the cutter body's slanting surface 2 before the clamping ring's contact surface 5 comes into contact with the cutter ring segments' slanting surface 7. The spring also ensures that the ring is not knocked off by impact during the operation.

The clamping ring has a threaded portion 15 with threads adapted to the cutter body's threaded portion 6, which has a specially designed thread and is preferably tapered with a taper of between 2 and 10°. The threads are designed so as to be self-locking when the clamping ring 4 is tightened, but with male and female threads with a large clearance both radially and axially. With a tapered thread there is little radial clearance in a tightened state. With a design of this kind, the threaded connection is loosened if the clamping ring is only turned a short distance, thereby making it easy to continue turning the clamping ring by hand as soon as it is loosened by a suitable tool. The threads 6 on the cutter body and the corresponding threads 15 on the clamping ring give the same clearance in all directions after 360° relative turning after release.

The savings obtained by using divided cutter rings can only be achieved by designing a cutter that is so robust that a great many rings can be worn down and replaced before the whole cutter has to be dismantled for service. Since both divided and undivided rings may be mounted on the same cutter, the cutter attachment may be designed in such a manner that even undivided cutter rings can be replaced without the rest of the cutter having to be dismantled. This requires specially designed mounting brackets. One can tell from experience on which cutter positions it is desirable to be able to mount undivided rings. Only a few positions out towards the periphery of the drill head are normally involved.

There are many variants of mounting brackets for cutters, for cutter replacement from the front or rear of the drill head. An example of a mounting bracket for replacement of an undivided ring from the front of the drill head is illustrated in FIGS. VIA, B and C.

In FIG. VI a mounting bracket has end attachments 21, 22 for the cutter 20. The ends of the cutter are fastened by means of strong bolts.

One attachment point 22 for the mounting bracket can be pivoted about the pin 23 mounted in thick-walled, soft artificial fibre rings 24, which give the end attachment 22 a springing suspension relative to the pins 23.

During drilling, the end attachment 22 is secured on both sides by the bolts 25 that fasten it to the sides 26 of the mounting bracket. The end attachment 22 has sloping contact surfaces 27 on both sides in order to maintain centring of the cutter during drilling. The end attachment 22 also has a sloping surface 28 that ensures that the cutter is secured in the axial direction.

When the cutter rings 3 have to be replaced, the cutter's end attachment 21 and the bolts 25 are released. The cutter 20, which is still secured in the attachment 22, can thereby be pivoted about the pins 23, thus enabling the clamping ring 4 and the cutter rings 3 to be dismantled and a new cutter ring mounted without dismantling the actual cutter.

The figures only illustrate embodiments of the invention and many variants are possible within the principle of the invention. An example of such a variant is that instead of the groove 29 for a chisel (FIG. VB) employed for tightening the clamping ring, the clamping ring may have holes 32 in the lateral edge for inserting an arm (such as a pipe, rod, or the like) for use in the tightening process (FIG. VC). During tightening and releasing the cutter body must be blocked against rotation, for example by a rod 31 being inserted in a hole 30 in the body 1 (see FIG. II), thereby blocking against rotational movement since the rod's other end normally abuts against the mounting bracket or the drill head.

There will normally be 2–4 holes for the blocking rod, 2 of which are preferably located at the gap between the cutter ring halves.

What is claimed is:

1. A cutter for a tunnel boring machine, which cutter comprises a cutter body (1) designed with a slanting surface (2) for interaction with a slanting surface (8) on a cutter ring with a dovetailed foot (3), which cutter ring 3 may be whole or divided into segments (3*a*, 3*b*), which cutter ring (3) has an inner cylindrical contact surface (11), which interacts with an outer cylindrical contact surface (12) on the cutter body (1), whereby the cutter body (1) is designed with a threaded portion with threads (6), which interact with corresponding suitable threads on a clamping ring (4), which clamping ring has a slanting surface (5), which interacts with a slanting surface (7) on the cutter ring (3) in order to exert both radial and axial clamping forces on the caller ring (3) when the cutter ring is secured on the cutter body, further wherein the threads on the cutter body (1) are conically tapered and interact with corresponding conically tapered threads on the clamping ring (4), and that the diameter of the cutter ring's (3) inner cylindrical contact surface (11) has a clearance tolerance relative to the diameter of the outer cylindrical contact surface (12) of the cutter body (1), which clearance tolerance between the cutter ring (3) and the cutter body (1) decreases when the cutter ring is secured to the cutter body by virtue of tightening of the clamping ring (4), characterized in that the slanting surface (5) is provided with a groove (13) around the entire circumference, which receives a spring (14) of a corrugated nature, with a plurality of waves with wave crests, which in an unloaded state, project over the slanting surface (5).

2. A cutter for a tunnel boring machine, which cutter comprises a cutter body (1) designed with a slanting surface (2) for interaction with a slanting surface (8) on a cutter ring with a dovetailed foot (3), which may be whole or divided into segments (3*a*, 3*b*), which cutter ring (3) has an inner cylindrical contact surface (11), which interacts with an outer cylindrical contact surface (12) on the cutter body (1), whereby the cutter body (1) is designed with a threaded portion with threads (6), which interact with corresponding suitable threads on a clamping ring (4), which clamping ring has a slanting surface (5), which interacts with a slanting surface (7) on the cutter ring (3) in order to exert both radial and axial clamping forces on the cutter ring (3) when the cutter ring is secured on the cutter body, further wherein the threads on the cutter body (1) are conically tapered and interact with corresponding conically tapered threads on the clamping ring (4), and that the diameter of the cutter ring's (3) inner cylindrical contact surface (11) has a clearance tolerance relative to the diameter of the outer cylindrical contact surface (12) of the cutter body (1), which clearance tolerance between the cutter ring (3) and the cutter body (1) decreases when the cutter ring is secured to the cutter body by virtue of tightening of the clamping ring (4), characterised in that when the ring is clamped on the cutter body, the innermost part of the cutter ring's free lateral surfaces (9, 10) extends outwards at an angle that is at least parallel to the plane through the edge of the cutter ring, but less than perpendicular to said plane.

3. A cutter for a tunnel boring machine, which cutter comprises a cutter body (1) designed with a slanting surface (2) for interaction with a slanting surface (8) on a cutter ring with a dovetailed foot (3), which cutter ring 3 may be whole or divided into segments (3*a*, 3*b*), which cutter ring (3) has an inner cylindrical contact surface (11), which interacts with an outer cylindrical contact surface (12) on the cutter body (1), whereby the cutter body (1) is designed with a threaded portion with dreads (6), which interact with corresponding suitable threads on a clamping ring (4), which clamping ring has a slanting surface (5), which interacts with a slanting surface (7) on the cutter ring (3) in order to exert both radial and axial clamping forces on the cutter ring (3) when the cutter ring is secured on the cutter body, further wherein the threads on the cutter body (1) are conically tapered and interact with corresponding conically tapered threads on the clamping ring (4), and that the diameter of the cutter ring's (3) inner cylindrical contact surface (11) has a clearance tolerance relative to the diameter of the outer cylindrical contact surface (12) of the cutter body (1), which clearance tolerance between the cutter ring (3) and the cutter body (1) decreases when the cutter ring is secured to the cutter body by virtue of tightening of the clamping ring (4), characterised in that respective ends of the cutter body (1) are attached to a mounting bracket by means of end attachments (21, 22), wherein one of the end attachments is releasable from the mounting bracket such that the cutter ring (3) may be replaced without the cutter being dismantled.

4. A cutter according to claims 1 or 3, with an undivided cutter ring (3), characterised in that the cutter ring (3) has a groove (17) corresponding to a positioning plug (19) in the cross sectional shape.

5. A cutter according to either of claim 1 or 2, characterised in that in the case of a divided cuter ring (3) consisting of a number of segments (3*a*, 3*b*) on at least one side of the segment in the dividing area's inner portion, a bevelling (17) of the lateral surface is performed.

* * * * *